US008549700B2

(12) United States Patent
Hwang et al.

(10) Patent No.: US 8,549,700 B2
(45) Date of Patent: Oct. 8, 2013

(54) VISUALIZATION DEVICE FOR DUST COLLECTION OF VACUUM CLEANER

(75) Inventors: Geunbae Hwang, Changwon-si (KR); Kyeongseon Jeong, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/378,641

(22) PCT Filed: Nov. 4, 2009

(86) PCT No.: PCT/KR2009/006459
§ 371 (c)(1),
(2), (4) Date: Dec. 15, 2011

(87) PCT Pub. No.: WO2011/055866
PCT Pub. Date: May 12, 2011

(65) Prior Publication Data
US 2012/0090128 A1 Apr. 19, 2012

(51) Int. Cl.
*A47L 9/19* (2006.01)

(52) U.S. Cl.
USPC ..... 15/339; 15/352; 15/353

(58) Field of Classification Search
USPC ..... 15/339, 347, 352, 353
IPC ..... A47L 9/10, 9/16, 9/19
See application file for complete search history.

(56) References Cited

U.S. PATENT DOCUMENTS 4,100,878 A * 7/1978 Leinfelt ..... 116/268
7,562,414 B2 * 7/2009 Oh et al. ..... 15/339
7,805,803 B2 * 10/2010 Andrup et al. ..... 15/339

(Continued)

FOREIGN PATENT DOCUMENTS

EP 1 199 023 A1 4/2002
EP 1 452 120 A1 9/2004

(Continued)

OTHER PUBLICATIONS

International Search Report issued in PCT Application No. PCT/KR09/006459 dated Jul. 28, 2010.

(Continued)

*Primary Examiner* — David Redding
(74) *Attorney, Agent, or Firm* — KED & Associates LLP

(57) ABSTRACT

The present invention relates to a visualization device for dust collection of a vacuum cleaner, the visualization device includes a collecting unit mounted on one side of a pathway on which the suction force of a vacuum cleaner for sucking dust is transmitted, and moves at least some of the sucked dust in one direction, a dust collecting unit of transparent material coupled with the collecting unit and exposes a state of dust received by the collecting unit to the outside, a discharge unit which guides air and dust, which has passed through the dust collecting unit, to be discharged into the pathway that transmits the suction force of the vacuum cleaner, a foreign material separation unit provided in the dust collecting unit to generate cyclonic flow, and a foreign material discharge unit inserted into the inside of the foreign material separation unit by the manipulation of a user from one side of the dust collecting unit and allows the inflow of air from the outside into the inside thereof to discharge dust from the inside of the dust collecting unit while breaking the cyclonic flow. Accordingly the invention enables the user to check the status of the dust that is sucked and the convenient discharge of the dust collected in the inside of the collecting unit.

11 Claims, 12 Drawing Sheets

(56) References Cited

U.S. PATENT DOCUMENTS

| | | | | |
|---|---|---|---|---|
| 7,987,550 | B2 * | 8/2011 | Nielsen | 15/339 |
| 8,172,932 | B2 * | 5/2012 | Oh et al. | 96/382 |
| 2004/0255425 | A1 | 12/2004 | Arai et al. | 15/300.1 |

FOREIGN PATENT DOCUMENTS

| | | | |
|---|---|---|---|
| EP | 1 674 009 | A2 | 6/2006 |
| JP | 2004-057445 | A | 2/2004 |
| JP | 2007-117143 | A | 5/2007 |
| JP | 2007-330457 | A | 12/2007 |
| JP | 2008-036254 | A | 2/2008 |

OTHER PUBLICATIONS

European Search Report dated Mar. 22, 2013 issued in Application No. 09 85 1122.

* cited by examiner

VISUALIZATION DEVICE FOR DUST COLLECTION OF VACUUM CLEANER

BACKGROUND OF THE INVENTION

1. Technical Field

The present invention relates to a visualization device for dust collection of a vacuum cleaner for confirming the dust suction status 2. Description of the Related Art Typically, the vacuum cleaner is a device in which dust and the foreign material together with air are sucked by using a suction motor mounted in the inside of the body to filter the sucked dust and the foreign material in the inside of the main body.

The vacuum cleaner as described above can be mainly classified as a canister type in which a suction nozzle unit is communicated with the main body through a connection tube and an upright type in which the main body is integrally formed with the suction nozzle unit.

In the vacuum cleaners as classified above, collecting devices of a bag filtering type or a cyclone dust collecting type, which filter dust and the foreign material among sucked air and store the filtered dust and the foreign material, may be used. Further, due to reasons such as ease of use and maintenance costs, the cyclone dust collecting type is mainly employed in recently released, most vacuum cleaners.

Meanwhile, in a case that the user performs the cleaning process using the vacuum cleaner, when the user checks whether the dust is sucked, confidence in the performance of the vacuum cleaner and the satisfaction of the cleaning process can be improved.

Thus, in order to meet the needs of the user as described above, there is a need for a visualization device that suction status of dust according to the cleaning process is displayed on the outside.

SUMMARY OF THE INVENTION

An object of the present invention is to provide a visualization device for dust collection of a vacuum cleaner in which some of sucked dust during the cleaning process is exposed to the outside and accordingly the user directly confirms suction status of dust.

Another object of the present invention is to provide a visualization device for dust collection of a vacuum cleaner in which collected dust is effectively discharged in order to visualize the dust suction status.

According to the prevent invention, the visualization device for dust collection of a vacuum cleaner, comprising a collecting unit mounted on one side of a pathway on which the suction force of a vacuum cleaner for sucking dust is transmitted, and moves at least some of the sucked dust in one direction, a dust collecting unit, which is transparent material, coupled with the collecting unit and exposes a state of dust received by the collecting unit to the outside, a discharge unit which guides air and dust, which has passed through the dust collecting unit, to be discharged into the pathway that transmits the suction force of the vacuum cleaner, a foreign material separation unit provided in the dust collecting unit to generate cyclonic flow, and a foreign material discharge unit inserted into the inside of the foreign material separation unit by the manipulation of a user from one side of the dust collecting unit and allows the inflow of air from the outside into the inside thereof to discharge dust from the inside of the dust collecting unit while breaking the cyclonic flow.

DESCRIPTION OF THE PREFERRED EMBODIMENTS

Hereinafter, embodiments of the present invention will be concretely described with reference to drawings. The present invention is not limited to embodiments as proposed and various modified embodiments can be available by those skilled in the art without the scope of the present invention. In addition, these modified embodiments should not be appreciated separately from technical spirits or prospects.

Figure 1:
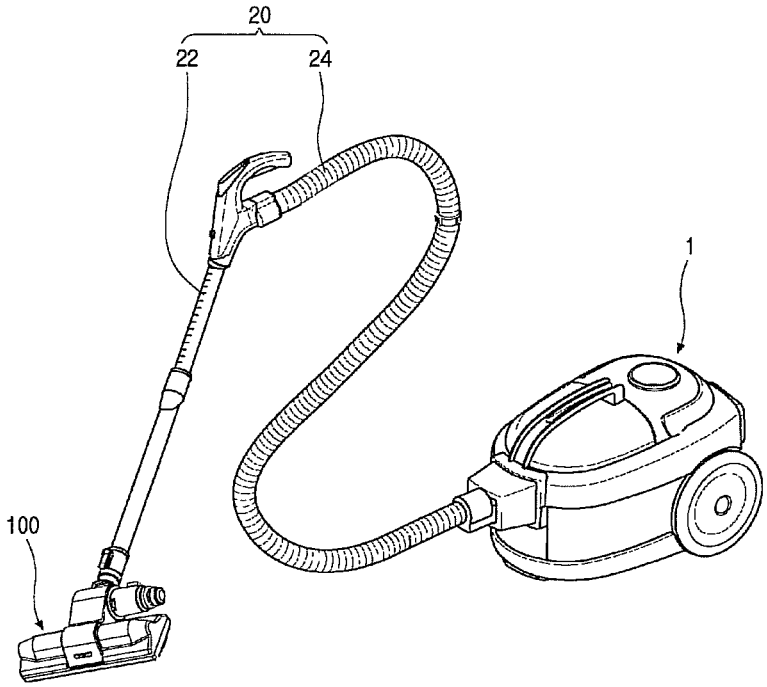
FIG. 1 is a diagram illustrating an appearance of a vacuum cleaner of an embodiment employed in the present invention.
Figure 2:
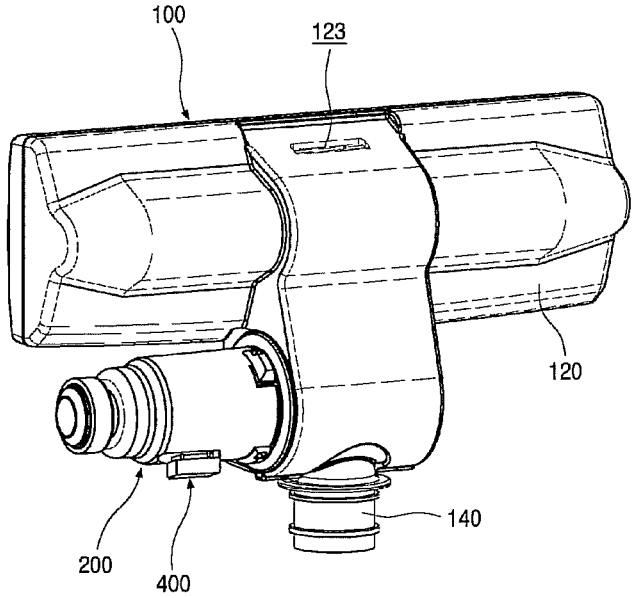
FIG. 2 is a diagram illustrating a status where a visualization device for dust collection of the vacuum cleaner is mounted on one side of a suction nozzle according to the embodiment of the present invention.
Figure 3:
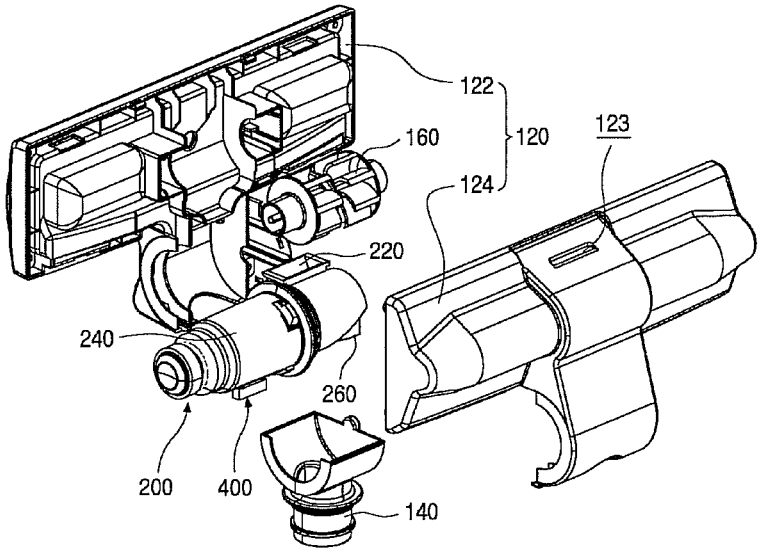
FIGS. 3 and 4 are diagrams illustrating configurations that the visualization device for dust collection of the vacuum cleaner is mounted according to the embodiment of the present invention.
Figure 4:
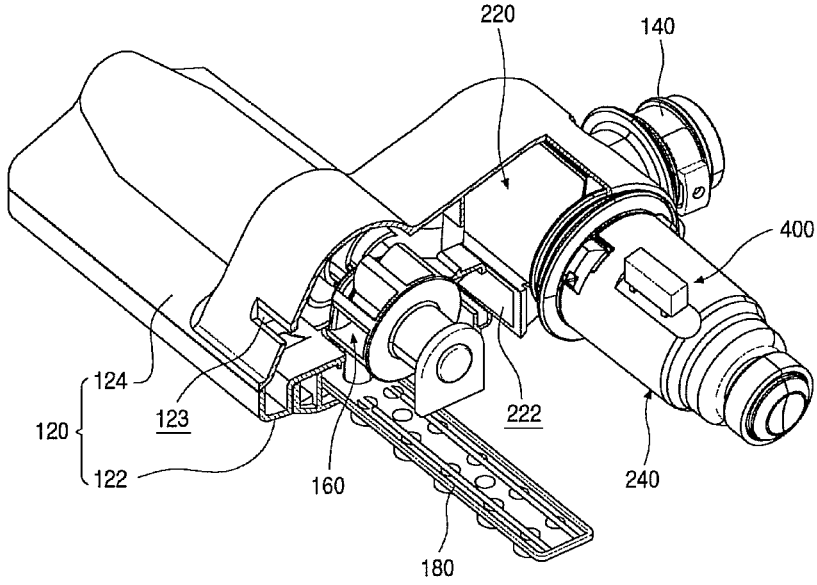

FIG. 1 is a diagram illustrating an appearance of a vacuum cleaner of a embodiment employed in the present invention, FIG. 2 is a diagram illustrating a status where a visualization device for dust collection of the vacuum cleaner is mounted on one side of a suction nozzle according to the embodiment of the present invention, and FIGS. 3 and 4 are diagrams illustrating configurations that the visualization device for dust collection of the vacuum cleaner is mounted according to the embodiment of the present invention.

As shown in the drawings, the vacuum cleaner employed in the present invention includes a main body 1 which generates a suction force by using a suction motor, a connection unit 20 which transmits the generated suction force in the main body 1, and a suction nozzle 100 which is provided to one side of the connection unit 20 to suck water scattered on a surface to be cleaned with air.

The connection unit 20 may include a length adjustable extension pipe 22 on which the suction nozzle 100 is mounted to the one end, and a connection pipe 24 of flexible material connecting the extension pipe 22 to the main body 1

The suction nozzle 100 is formed into an appearance by a case 120 and the case 120 is formed by the upper case 124 and the lower case 122 connected each other.

In addition, the upper case 124 and the rear end of the lower case 122 are provided with a connection unit 140 having the diameter corresponding to the diameter of the extension pipe 22 to be fittingly mounted on the extension pipe 22.

Meanwhile, the one side of the case 120 is provided with the visualization device 200 of dust collection for outside visualizing the collection status of the foreign material on the one side of the pathway of the suction force generated from the main body 1.

According to the one embodiment of the present invention, the visualization device 200 of dust collection is intended to receive air collected through the suction nozzle 100 and a portion of dust included in the air and to show the receiving status of the dust on the outside. Accordingly, the visualization device 200 is located on the front of the connection unit 140 to shield a portion of flow path of air moved to the main body 1

Therefore, a portion of air moved to the main body 1 may be introduced into the visualization device 200 of dust collection.

Meanwhile, the suction nozzle 100 is fittingly mounted to the extension pipe 22 to clean bedding such as covers or mattress or knitted goods having down and fluff such as blanket or carpeting and includes a turbine 160 which generates vibration to the inside of the case 120 and a vibration frame 180 which generates vibration by rotating the turbine 160.

In addition, the upper case 124 is provided with an air intake hole 123 which introduces the outdoor air into the position corresponding to the mounted position of the turbine 160 to smoothly rotate the turbine 160.

Accordingly, the turbine 160 rotates by using air introduced into the air intake hole 123 with air introduced into suction port (not shown) formed on the lower of the suction nozzle 100.

In addition, since the turbine 160 and the vibration frame 180 are connected by using an eccentric cam each other, when the turbine 160 rotates, the vibration frame 180 connected to the turbine 160 is vibrated.

In addition, since the turbine 160 is disposed to the position of the front of the visualization device 200 of dust collection, air forced for flow by the turbine 160 and dust included in the air may be easily introduced into the inside of the visualization device 200 of dust collection.

Meanwhile, according to the embodiment of the present invention, the visualization device 200 of dust collection is largely configured to include the collecting unit 220 which guides air sucked through the suction nozzle 100 and dust introduced into the inside and the dust collecting unit 240 which collects dust introduced through the collecting unit 220 and outside exposes the collected dust.

The collecting unit 220 is formed by a cylindrical shape that the upper side is opened and the edge of the upper end is provided with the case 120 to maintain the fixed position. Further, the collecting unit 220 may include a mounting protrusion (not shown) formed by outwardly protruding so as to not leak air and dust sucked in the case 120 into the mounting portion of the visualization device 200 of dust collection.

In particular, the external surface of the collecting unit 220, which is protruded for the portion forward the mounting location of the turbine 160, and the protruded portion is formed with the suction inlet 222 that air and dust may be introduced into the collecting unit 220.

The suction inlet 222 is formed to guide the flow of air into a tangential direction of the inside of the collecting unit 220, and air introduced inside the collecting unit 220 is moved while rotating along the inner surface.

The upper side of the collecting unit 220 is mounted with the dust collecting unit 240 in which air transferred while rotating and dust through the suction inlet 222 included in the air are received.

The dust collecting unit 240 is formed by the transparent material which may be exposed to the outside of the dust reception status and the inside of the dust collecting unit 240 is further provided with a foreign material separation unit 270 which generates a cyclonic flow to separate dust and air.

In addition, the side portion of the dust collecting unit 240 is further provided with the foreign material discharge unit 400 which crushes the cyclonic flow of the foreign material separation unit 270 while introducing the outdoor air into the inside to discharge air collected in the inside of the dust collecting unit 240.

The dust discharged to the outside by the foreign material discharge unit 400 may be discharged through a discharge unit 260 communicated with the dust collecting unit 240.

Figure 5:
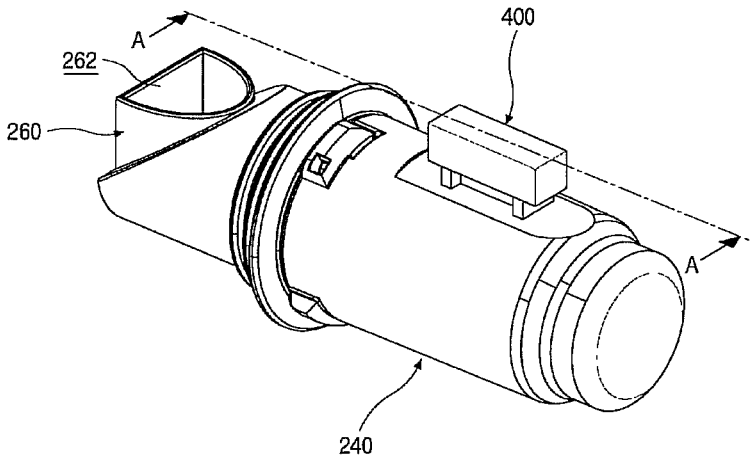
FIG. 5 is a diagram illustrating an appearance of the visualization device for dust collection of the vacuum cleaner according to the embodiment of the present invention.
Figure 6:
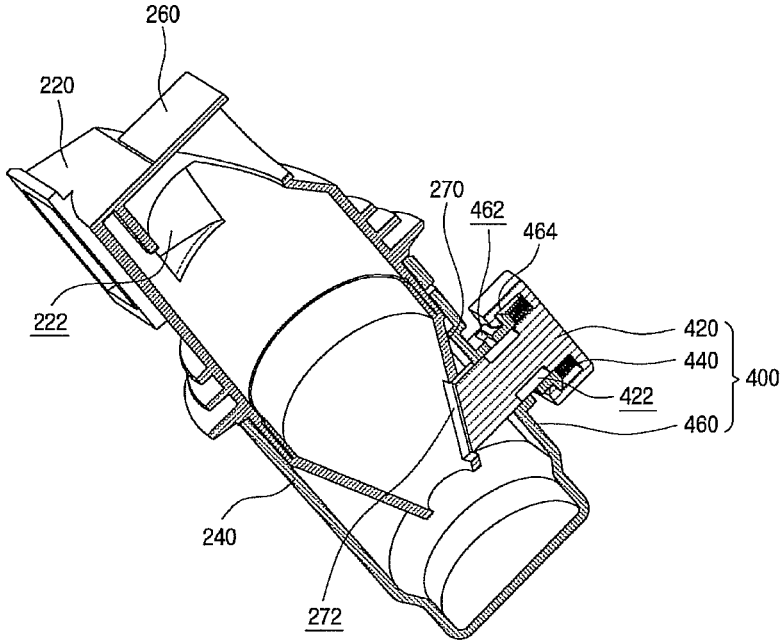
FIG. 6 is a cross sectional view taken along A-A of FIG. 5.

Meanwhile, FIG. 5 is a diagram illustrating an appearance of the visualization device for dust collection of the vacuum cleaner according to an embodiment of the present invention, and FIG. 6 is a cross sectional view taken along A-A of FIG. 5.

Referring to the drawings, the foreign material separation unit 270 is lengthily foamed with a foreign material discharge slit 272 in the lateral direction of the side portion.

In addition, the foreign material discharge slit 272 formed as described above is provided with a end portion of a foreign material discharge button 420 which is a configuration of the foreign material discharge unit 400 to maintain the same plane as the inside surface of the foreign material separation unit 270. In such a state, the cyclonic flow formed by the foreign material separation unit 270 may be smoothly accomplished.

The foreign material discharge unit 400 includes the foreign material discharge button 420 as described above, a button housing 460 which receives one side of the foreign material discharge button 420 to press the foreign material discharge button 420 by the external pressure and to guide to slidingly be moved the inside of the dust collecting unit 240, and an elastic member 440 included between the foreign material discharge button 420 and the button housing 460.

In detail, the upper portion of the foreign material discharge button 420 has the upper surface of flat-panel form to allow the user to facilitate the pressurization, and the lower side is formed by a narrower width than width of the upper potion to penetrate the one side of the dust collecting unit 240.

To this end, the side portion of the dust collecting unit 240 is formed with a perforated portion by a size corresponding to the foreign material discharge button 420 and the perforated portion is mounded with the button housing 460.

Accordingly, the button housing 460 is formed to correspond to perforated portion of the dust collecting unit 240 and the center portion is corresponded to the diameter and shape of the foreign material discharge button 420 so that the foreign material discharge button 420 may be passed.

In addition, the upper portion of the button housing 460 is provided with a chin rest 464 outwardly protruded by the predetermined length such that the chin rest 464 and the upper inside of the foreign material discharge button 420 are interfered each other and, the elastic member 440 are provided between the chin rest 464 and the upper inside of the foreign material discharge button 420 each other interfered as described above.

Meanwhile, the side portion of the button housing 460 is formed with a perforated portion and a by-pass hole 462 to introduce the outdoor air and the external surface of the foreign material discharge button 420 is further formed with an outdoor air intake unit 422 on which a recessed portion is formed in the inside side.

Herein, the outdoor air intake unit 422 is not formed from the lower end of the foreign material discharge button 420 to the dust collecting unit 240, but formed from exposed portion from the outside of the side portion of the dust collecting unit 240 to the upper side, such that the outdoor air introduced through the by-pass hole 462 is not introduced into the inside of the dust collecting unit 240 at the initial position of the foreign material discharge button 420 (see FIG. 6).

Figure 7:
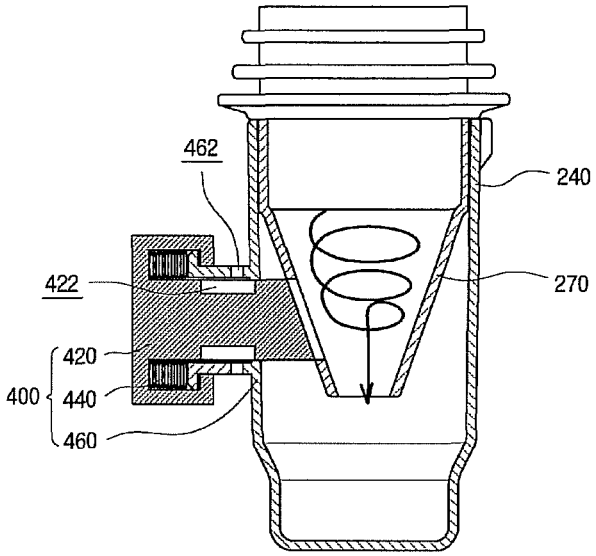
FIG. 7 is a diagram illustrating an initial position that the visualization device for dust collection of the vacuum cleaner is provided with a foreign material discharge unit which is a main configuration according to the embodiment of the present invention.
Figure 8:
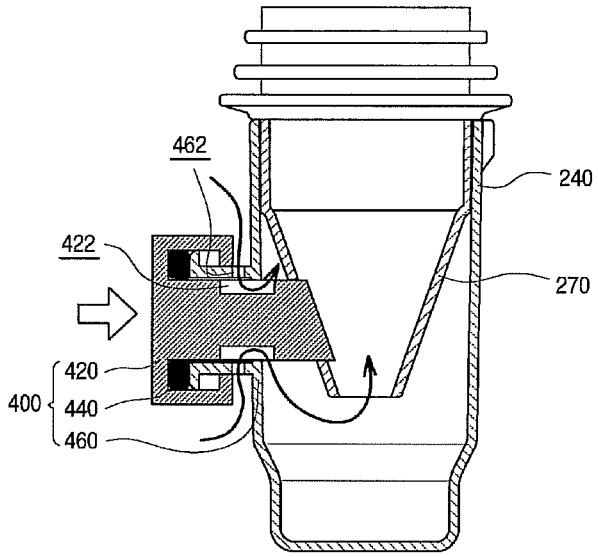
FIG. 8 is a diagram illustrating a status where the foreign material discharge unit is pressurized in FIG. 7.

For a more detailed description, FIG. 7 is a diagram illustrating an initial position that the visualization device for dust collection of the vacuum cleaner is provided with a foreign material discharge unit which is a main configuration according to the embodiment of the present invention and FIG. 8 is a diagram illustrating a status where the foreign material discharge unit is pressurized in FIG. 7.

Referring to the drawings, as shown in FIG. 7, when the foreign material discharge unit 400 maintains the initial mounting position, the foreign material discharge button 420 shields the foreign material discharge slit 272 and the dust and air may be separated while smoothly accomplishing the cyclonic flow that occurs in the foreign material separation unit 270.

That is, the end portion of the foreign material discharge button 420 is formed to have the same slope and curvature as the foreign material discharge slit 272 and accordingly the cyclonic flow is accomplished continually not without breaking, by shielding the foreign material discharge slit 272.

Meanwhile, in the status as described above, when the user presses the foreign material discharge button 420, as shown in FIG. 8, the foreign material discharge button 420 passes the foreign material discharge slit 272 to enter into the inside of the foreign material separation unit 270.

Accordingly, the foreign material discharge button 420 entered into the inside of the foreign material separation unit 270 as described above crushes the cyclonic flow formed along the internal surface of the foreign material separation unit 270, such that the outdoor air introduced through the by-pass hole 462 may be introduced into the inside of the dust collecting unit 240 through the outdoor air intake unit 422 and the collected dust in the dust collecting unit 240 may be scattered and discharged into the outside of the dust collecting unit 240.

In the status, when the external pressure applied to the foreign material discharge button 420 is released, the foreign material discharge button 420 is returned to the initial position by the elastic member 440 and the outdoor air intake unit 422 is shielded by the dust collecting unit 240. Further, the end portion of the foreign material discharge button 420 shields the foreign material discharge slit 272 and the cyclonic flow is smoothly maintained again such that the dust may be separated.

Meanwhile, in another embodiment of the present invention, the foreign material discharge unit 400 may consist of other types.

Figure 9:
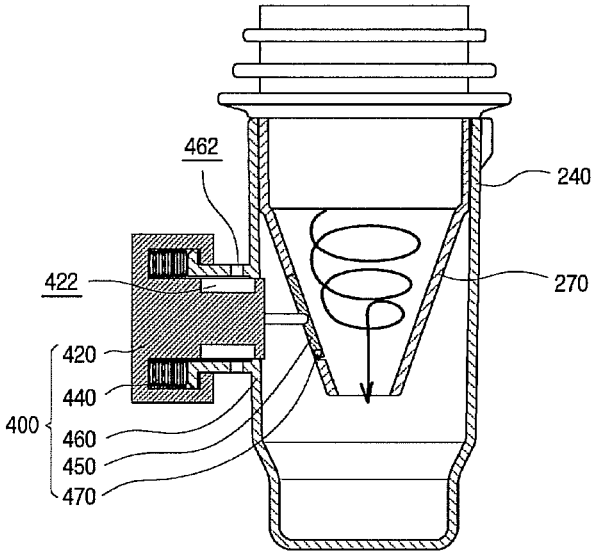
FIG. 9 is a diagram illustrating an initial position that a visualization device for dust collection of a vacuum cleaner is provided with a foreign material discharge unit which is a main configuration according to another embodiment of the present invention.
Figure 10:
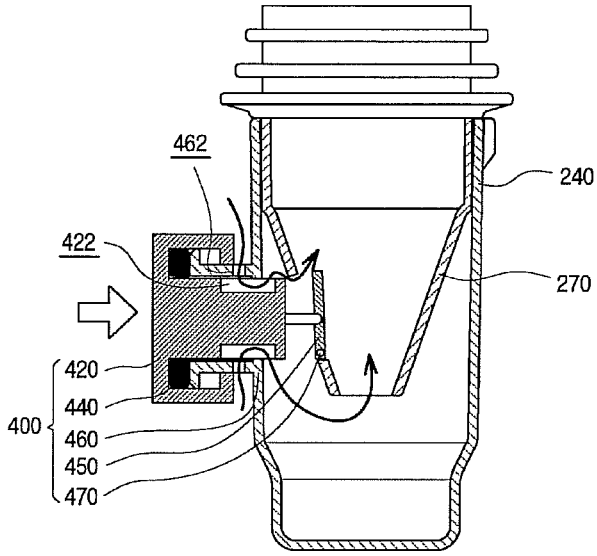
FIG. 10 is a diagram illustrating a status where the foreign material discharge unit in FIG. 9 is pressurized.

FIG. 9 is a diagram illustrating an initial position that the visualization device for dust collection of the vacuum cleaner is provided with a foreign material discharge unit which is a main configuration according to another embodiment of the present invention and FIG. 10 is a diagram illustrating a status where the foreign material discharge unit is pressurized in FIG. 9.

As shown in the drawings, in another embodiment of the present invention, the foreign material discharge unit 400 for discharging the collected dust in the dust collecting unit 240 is provided with a plug 450 formed by the size and shape corresponding to the foreign material discharge slit 272 to shield the foreign material discharge slit 272.

In addition, the foreign material discharge button 420, which performs the same functions as the above embodiment, is provided to the side portion of the dust collecting unit 240 to press the plug 450 by the external pressure and the inside of the dust collecting unit 240 is further provided with the button housing 460 which guides the pressing path of the foreign material discharge button 420.

Further, as mentioned embodiments, when releasing the pressure of the foreign material discharge button 420, the elastic member 440 is provided between the button housing 460 and the foreign material discharge button 420 such that the foreign material discharge button 420 may return to the initial position and the one side of the plug 450 is rotatably fixed to the button housing 460 by a hinge 470

In detail, the lower portion of the plug 450 is fixed by the hinge 470 in the lower portion of the button housing 460, and the center portion is connected to the foreign material discharge button 420. In this case, when the foreign material discharge button 420 is pressurized, the upper portion of the plug 450 is rotated to the inside of the foreign material separation unit 270 around the hinge 470.

Therefore, the cyclonic flow formed in the inside of the foreign material separation unit 270 is broken by the rotation of the plug 450 as described above, and the dust collected in the dust collecting unit 240 is discharged while the outdoor air is introduced into the inside of the dust collecting unit 240 thorough a path as in the embodiment described above by the movement of the plug 450.

In addition, in another embodiment of the present invention, when the external pressure applied to the foreign material discharge button 420 is released, the foreign material discharge button 420 is returned to the initial position by the elastic member 440 and the plug 450 shields the foreign material discharge slit 272 and the cyclonic flow may be smoothly maintained again.

Meanwhile, in another embodiment of the present invention, the foreign material discharge unit 400 may consist of other types.

Figure 11:
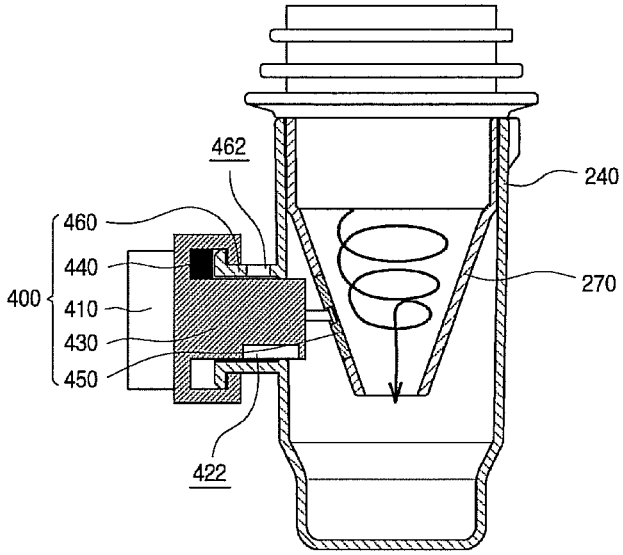
FIG. 11 is a diagram illustrating an initial position that a visualization device for dust collection of a vacuum cleaner is provided with a foreign material discharge unit which is a main configuration according to another embodiment of the present invention.
Figure 12:
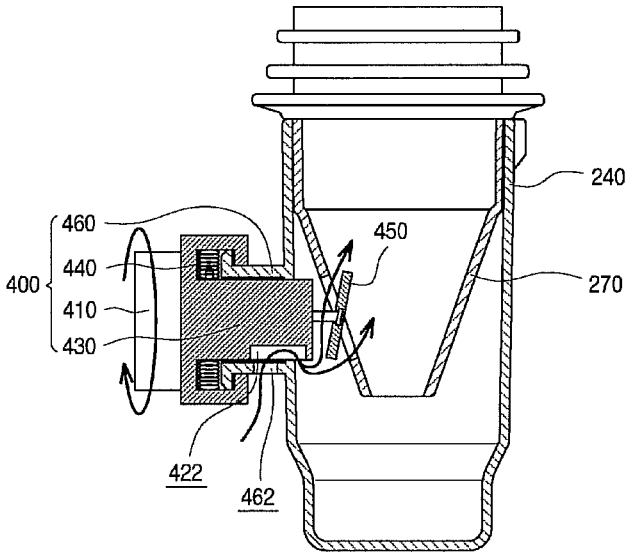
FIG. 12 is a diagram illustrating a status where the foreign material discharge unit in FIG. 11 is rotated.

FIG. 11 is a diagram illustrating an initial position that the visualization device for dust collection of the vacuum cleaner is provided with a foreign material discharge unit which is a main configuration according to another embodiment of the present invention and FIG. 12 is a diagram illustrating a status where the foreign material discharge unit is rotated in FIG. 11.

As shown in the drawings, in another embodiment of the present invention the foreign material discharge unit 400 includes a plug 450 formed with the size and shape corresponding to the foreign material discharge slit 272 to shield the foreign material discharge slit 272, a foreign material discharge knob 410 rotatably provided to the side portion of the dust collecting unit 240 and connected to the plug 450 to transmit the rotation force to the plug 450, and knob housing 430 provided to the inside of the dust collecting unit 240 to guide a rotation path of the foreign material discharge knob 410.

In detail, the portion of the foreign material discharge knob 410 is outwardly protruded to be rotated by the user' grip and fixed to the center portion of the plug 450 and when rotating after the user' grip, the plug 450 may be rotated together with the foreign material discharge knob 410.

In addition, although not shown in the drawings, the foreign material discharge knob 410 is formed with a perforated portion to introduce the outdoor air and the knob housing 430 is also formed with a predetermined size of hole selectively communicated with the perforated portion.

Accordingly, the hole formed into the knob housing 430 and the hole formed into the foreign material discharge knob 410 according to the rotation of the foreign material discharge knob 410 are communicated each other to guide the outdoor air into the inside of the dust collecting unit 240.

When the plug 450 is initially mounted, the plug 450 is disposed to have the same slope direction and angle as the internal surface of the foreign material separation unit 270 and is connected with the foreign material discharge knob 410, the one side of the plug 450 shielding the foreign material discharge slit 272 is formed to have the same type as an internal slope and curvature of the foreign material separation unit 270, like the foreign material discharge button 420 (see FIG. 6) of the above mentioned embodiment.

Accordingly, in such a state, the cyclonic flow of the foreign material separation unit 270 may be smoothly accomplished and the dust may be easily separated.

Meanwhile, in the status, when the foreign material discharge knob 410 is rotated by the user' grip, as shown in FIG. 12, the slope direction of the plug 450 is changed while the plug 450 is rotated so that the portion of the plug 450 may be entered into the inside of the foreign material separation unit 270.

As a result, the cyclone flow formed in the inside of the foreign material separation unit 270 is crushed and at the same time, the outdoor air is introduced into the internal side of the inside of the dust collecting unit 240 and the dust of the dust collecting unit 240 is discharged outside by passing the foreign material discharge knob 410 and the knob housing 430 through the foreign material discharge slit 272.

The discharge of dust as above is performed until the foreign material discharge knob 410 is moved to the initial position by the user, and when the foreign material discharge knob 410 is moved to the initial position, the cyclonic flow of the foreign material separation unit 270 is smoothly accomplished while the foreign material discharge slit 272 is again shield.

Meanwhile, the elastic member 440 is further provided between the foreign material discharge knob 410 and the knob housing 430 so that when the applied force is released by the user to rotate the foreign material discharge knob 410, the foreign material discharge knob 410 may return to the initial position by the elastic force at the same time.

To this end, the foreign material discharge knob 410 is further provided with the elastic member connection unit 412 to be connected with elastic member 440, and the elastic member 440 is tensioned and the elastic force is stored according to the increasing rotation to be restored when the force used to take the rotation of the foreign material discharge knob 410 is released.

In the present invention, since a suction status of dust is exposed to the outside of the dust collecting unit, the user can easily confirm the dust suction status.

In addition, the dust collecting unit is provided with a foreign material discharge unit for forcibly discharging collected dust and the foreign material discharge unit crushes cyclonic flow of a foreign material separation unit while introducing outdoor air into the inside of the dust collecting unit through the user' pressure operation or rotation operation. Therefore, dust collected in the dust collecting unit can be effectively discharged.

Although preferred embodiments of the present invention have been illustrated and described, the present invention is not limited to the above-mentioned embodiments and various modified embodiments can be available by those skilled in the art without the scope of the appended claims of the present invention. In addition, these modified embodiments should not be appreciated separately from technical spirits or prospects.

What is claimed is:

1. A visualization device for dust collection of a vacuum cleaner, comprising:

a collecting unit mounted on one side of a pathway on which the suction force of a vacuum cleaner for sucking dust is transmitted to move at least some of the sucked dust in one direction;

a dust collecting unit coupled with the collecting unit and exposes a state of dust received by the collecting unit to the outside;

a discharge unit which guides air and dust, which has passed through the dust collecting unit, to be discharged into the pathway that transmits the suction force of the vacuum cleaner;

a foreign material separation unit provided in the dust collecting unit to generate cyclonic flow; and a foreign material discharge unit inserted into the inside of the foreign material separation unit by the manipulation of a user from one side of the dust collecting unit and allows the inflow of air from the outside into the inside of the dust collecting unit to discharge dust from the inside of the dust collecting unit while breaking the cyclonic flow.

2. The visualization device according to the claim 1, the foreign material separation unit is formed with a foreign material discharge slit which is selectively opened and closed by the foreign material discharge unit.

3. The visualization device according to the claim 2, wherein the foreign material discharge unit includes:

a foreign material discharge button provided on the side of the dust collecting unit to selectively shield the foreign material discharge slit while slidingly moving in the inside of the dust collecting unit by external pressure;

a button housing which guides a sliding movement of the foreign material discharge button; and an elastic member for returning the foreign material discharge button to the initial position when releasing the pressure of the foreign material discharge button.

4. The visualization device according to the claim 3, wherein the end portion of the foreign material discharge button is formed as the size and shape corresponding to the foreign material discharge slit and forms the same plane as the inner surface of the foreign material separation unit to prevent the cyclonic flow from crushing in a state where the end portion is inserted into the foreign material discharge slit.

5. The visualization device according to the claim 3, wherein the button housing is provided with a by-pass hole to introduce an outdoor air into the inside of the dust collecting unit and the foreign material discharge button is formed with an outdoor air intake unit communicated with the by-pass hole when pressing to introduce the outdoor air into the inside of the dust collecting unit.

6. The visualization device according to the claim 2, wherein the foreign material discharge unit includes:

a plug formed in the size and shape corresponding to the foreign material discharge slit to shield the foreign material discharge slit;

a foreign material discharge button provided to the side portion of the dust collecting unit to insert one side of the plug into the inside of the foreign material discharge slit by pressing the plug according to the external pressure;

a button housing provided to the inside of the dust collecting unit to guide a pressure path of the foreign material discharge button;

an elastic member provided between the button housing and the foreign material discharge button to return the foreign material discharge button to the initial position when releasing the pressure of the foreign material discharge button; and a hinge rotatably fixing the one side of the plug to the button housing.

7. The visualization device according to the claim 6, wherein the one side of the plug is provided in the same plane as the inner surface of the foreign material separation unit at the initial position to prevent the cyclonic flow from crushing.

8. The visualization device according to the claim 2, wherein the foreign material discharge unit includes:

a plug formed with the size and shape corresponding to the foreign material discharge slit to shield the foreign material discharge slit;

a foreign material discharge knob rotatably provided to the side portion of the dust collecting unit and connected to the plug to transmit the rotation force to the plug;

a knob housing provided to the inside of the dust collecting unit to guide a rotation path of the foreign material discharge knob.

9. The visualization device according to the claim 8, wherein the plug is connected to the foreign material discharge knob and forms the initial position to have the same slope direction as the external slop angle of the foreign material discharge unit.

10. The visualization device according to the claim 9, wherein in the plug, one side of the plug is inserted into the inside of the foreign material discharge unit while changing the slope direction when rotating of the foreign material discharge knob to crush the cyclonic flow.

11. The visualization device according to the claim 8, further including an elastic member between the foreign material discharge knob and the knob housing for returning the foreign material discharge knob to the initial position by elasticity.

* * * * *